US009126097B2

(12) United States Patent
Fettig

(10) Patent No.: US 9,126,097 B2
(45) Date of Patent: Sep. 8, 2015

(54) SNOWBOARD ACCESSORY

(71) Applicant: Jakob Diego Llanes Fettig, Golden, CO (US)

(72) Inventor: Jakob Diego Llanes Fettig, Golden, CO (US)

( * ) Notice: Subject to any disclaimer, the term of this patent is extended or adjusted under 35 U.S.C. 154(b) by 0 days.

(21) Appl. No.: 14/177,921

(22) Filed: Feb. 11, 2014

(65) Prior Publication Data

US 2015/0145222 A1 May 28, 2015

Related U.S. Application Data

(60) Provisional application No. 61/763,530, filed on Feb. 12, 2013.

(51) Int. Cl.

| | |
|---|---|
| ***A63C 11/02*** | (2006.01) |
| *A45F 3/14* | (2006.01) |
| *A63C 5/03* | (2006.01) |

(52) U.S. Cl.

CPC ..... *A63C 11/023* (2013.01); *A45F 3/14* (2013.01); *A63C 5/031* (2013.01)

(58) Field of Classification Search

CPC ... A63C 11/023; A63C 11/025; A63C 17/265
USPC ..... 280/809, 814, 816
See application file for complete search history.

(56) References Cited

U.S. PATENT DOCUMENTS

| | | | | |
|---|---|---|---|---|
| 4,190,182 | A * | 2/1980 | Hickey | 294/147 |
| 4,889,364 | A * | 12/1989 | Glaunes | 280/814 |
| 5,356,168 | A * | 10/1994 | Ozburn | 280/605 |
| 6,012,739 | A * | 1/2000 | Weiss et al. | 280/814 |
| 6,634,657 | B2 * | 10/2003 | Graham | 280/14.27 |
| 7,246,804 | B2 * | 7/2007 | Onoguchi | 280/14.27 |
| 2003/0020295 | A1 * | 1/2003 | Pikel | 294/159 |
| 2005/0212229 | A1 * | 9/2005 | Rawcliffe | 280/14.27 |
| 2005/0236830 | A1 * | 10/2005 | Moller | 280/814 |
| 2013/0048821 | A1 * | 2/2013 | Leet et al. | 248/316.4 |
| 2013/0207372 | A1 * | 8/2013 | Payson | 280/809 |
| 2013/0277926 | A1 * | 10/2013 | Rains | 280/14.27 |
| 2013/0292922 | A1 * | 11/2013 | Gyr | 280/606 |

* cited by examiner

*Primary Examiner* — John Walters
*Assistant Examiner* — Brian Swenson
(74) *Attorney, Agent, or Firm* — Duft Bornsen & Fettig LLP; Gregory T. Fettig

(57) ABSTRACT

Systems and methods herein provide a snowboard rider with a manner for carrying a snowboard more easily to and from a lift. In one embodiment, a system includes at least one grasping means (e.g., a handle or a strap) affixed to a top surface of a snowboard. The system also includes an attachment means for affixing the grasping means to the top surface of the snowboard. The grasping means allows a snowboarder to grab the snowboard to carry the snowboard and more easily transport it. The grasping means may also allow the snowboarder to perform certain tricks (e.g., by grabbing the grasping means in air).

3 Claims, 6 Drawing Sheets

SNOWBOARD ACCESSORY

CROSS REFERENCE TO RELATED APPLICATIONS

This patent application claims priority to and thus the benefit of an earlier filing date from U.S. Provisional Patent Application No. 61/763,530 (filed Feb. 12, 2013), the entire contents of which are hereby incorporated by reference.

FIELD OF THE INVENTION

The invention relates to snowboards and more particularly to accessories that allow a snowboarder to grasp a snowboard for carrying and/or to perform tricks.

BACKGROUND

Snowboarding is a sport where a user (a.k.a. a "rider" or a "snowboarder") binds to a relatively thin board for the purposes of sliding on snow in a manner similar to skiing. Snowboarding has been in existence for several decades and continues to be very popular to this day. Snowboarding allows a user to feel more closely connected to the slope of the mountain by allowing the snowboarder to "surf" the mountain. The advantages of snowboarding over skiing have been argued extensibly and continue to be argued to this day.

One certain advantage of snowboarding over skiing is the fact that snowboarders use snowboard boots that are relatively comfortable when compared to ski boots. Like skis, snowboards have bindings that bind the boots of the snowboarder to the snowboard so that the snowboarder can control the motion of the snowboard via the snowboarder's body. Snowboard bindings are removably/adjustably affixed to a single top surface of the snowboard as opposed to the bindings of two skis. And, snowboard boots are more like typical snow boots, as opposed to the rigid plastic boots of skiers, and allow the snowboarder to walk more normally than the clumsily navigated walk of a skier wearing ski boots.

Another advantage of snowboarding resides in the fact that the snowboarder does not use or otherwise require "poles" to navigate the snowboard down a mountain. As poles are not used in snowboarding, snowboarders have less gear to transport to the base of the mountain where the "lift" is located. For example, skiers and snowboarders alike generally carry their equipment from their car or their residence to a lift at the base of the mountain which carries the skiers/snowboarders upwards such that they may traverse down the snow-covered surface of the mountain. Skiers generally carry their skis and ski poles often using one hand, both hands, on shoulder, or in some otherwise contrived fashion to transport their skis to the lift. Snowboarders, on the other hand, simply grab their snowboards with one hand under an edge of the snowboard with a flat side of the snowboard resting against the body of the snowboarder. From there, the snowboarder simply walks to the lift and "straps in", being substantially ready to surf the mountain after being dropped off by the lift.

While the lesser amount of equipment is an advantage of snowboarding over skiing, snowboarders are still generally required to use a hand to transport their snowboard to the lift. Some additional equipment has been commercially presented to overcome this obstacle. For example, backpacks exist that allow a snowboarder to use straps to lash the snowboard to the snowboarder's back via the backpack. This is often desirable when the snowboarder is traversing mountains in the ungroomed/unmanaged "backcountry" because the snowboarder typically needs to bring supplies such as food, and extra carry on equipment such as avalanche gear on the outing. However, most snowboarders (and skiers for that matter) tend to ride on the slopes of groomed and/or managed "resort like" mountains such as those operated by Vail Resorts, Inc. Accordingly, there is less need for supplies and carry on equipment when the snowboarder goes out, resulting in less need for a bulky backpack during a snowboarder's ride.

SUMMARY

Systems and methods herein overcome the problems with the prior art by allowing a snowboarder to more easily carry the snowboard to and from a lift. In one embodiment, a system includes at least one grasping means affixed to a top surface of a snowboard and an attachment means for affixing the grasping means to the top surface of the snowboard. The grasping means allows a snowboarder to grab the snowboard to carry and transport the snowboard. The grasping means may also allow the snowboarder to perform certain tricks (e.g., by grabbing the grasping means in air).

The grasping means can be configured as a handle with a hinge affixed to the top surface of the snowboard near a lengthwise edge of the snowboard. In such an embodiment, the hinge is operable to provide movement of the handle from a first position proximate to the top surface of the snowboard to a second position away from the edge of the snowboard to allow the snowboarder to grab the handle and carry the snowboard. For example, the hinge may have an attachment plate so as to secure the hinge to the top surface of the snowboard via a screw or some other mechanism. A user may lock the hinge into these positions via a locking mechanism configured with the hinge. The hinge may also provide movement of the handle to a third position between the first and second positions and to lock the handle into the third position to allow the snowboarder to grab the snowboard to perform a trick while the snowboarder rides the snowboard. Additionally, a locking means, such as a compression clip configured from a semi-rigid plastic, may be operable to secure the handle in the first position while the snowboarder rides the snowboard.

Alternatively, the grasping means may be configured as a patch (or patches) of hook and loop attachment material affixed to the top surface (e.g., via adhesives, screws, etc.) of the snowboard proximate to a lengthwise edge of the snowboard. A strap comprising a patch (or patches) of opposing hook and loop attachment material may be affixed to a distal end (or ends) of the strap so as to attach the strap to the top of snowboard such that the snowboard may be carried by the rider. Other means for connecting a strap to the snowboard are shown and described below.

BRIEF DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION OF THE DRAWINGS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below.

Figure 1:
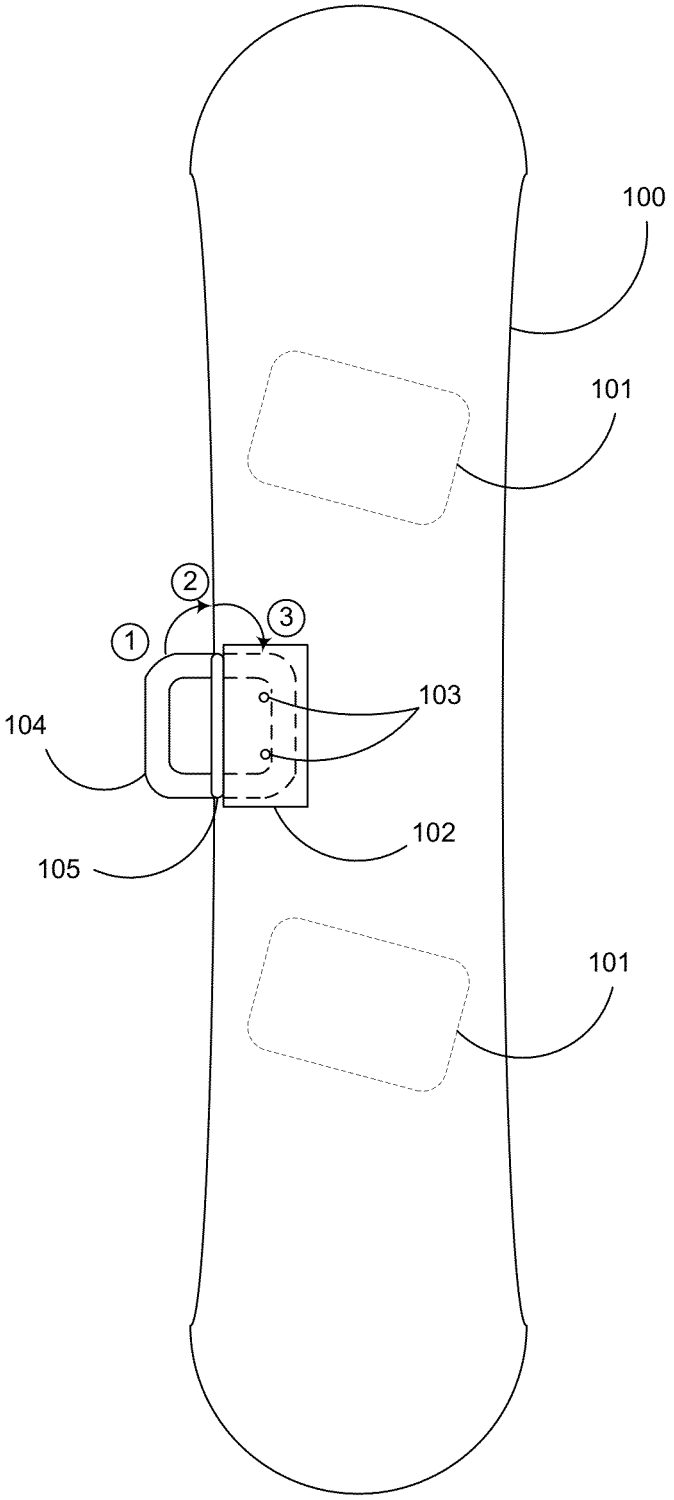
FIG. 1 is a block diagram of an exemplary accessory for a snowboard.

FIG. 1 is a block diagram of an accessory for a snowboard 100 in one exemplary embodiment of the invention. The snowboard 100 is configured as a typical snowboard with screw hole patterns for binding locations 101. In this embodiment, a handle 104 is affixed to the top side of the snowboard 100 and is operable to move between multiple positions to provide flexible usages of the snowboard 100 to the rider. For example, when the handle 104 is in the "1" position, the rider is able to grab the handle and easily carry the snowboard from place to place. When the handle 104 is in the "2" position, the rider can grab the handle during a snowboard ride to perform certain desired tricks. And, when the handle 104 is in the "3" position, the rider can ride the snowboard 100 without the handle 104 interfering with the ride of the snowboard 100.

The handle 104 may be affixed to the snowboard 100 in a manner that is similar to affixing the bindings to the snowboard at the binding locations 101. For example, the snowboard handle 104 may be configured with an attachment plate 102 that is configured with screw holes 103 for securing the handle 104 to the snowboard 100. In this regard, snowboard 100 may include screw insets that secure the attachment plate 102 when screws with matching threads are inserted through the screw holes 103 into the predrilled screw holes of the snowboard 100.

As mentioned, a rider may use the handle 104 in a variety of positions. Accordingly, the hinge 105 may include a locking mechanism that is operable to secure the handle in one of the three positions. For example, the hinge 105 may include some sort of gear or ratcheting mechanism that allows the handle 104 to be secured to multiple positions. Thus, if the rider desires to move the handle 104 to a certain position, such as when the rider is leaving a gondola to begin riding the snowboard 100, the rider adjusts the handle to the desired position (e.g., position 2 or position 3). A more detailed example of the handle 104 is shown and described in FIG. 2.

Figure 2:
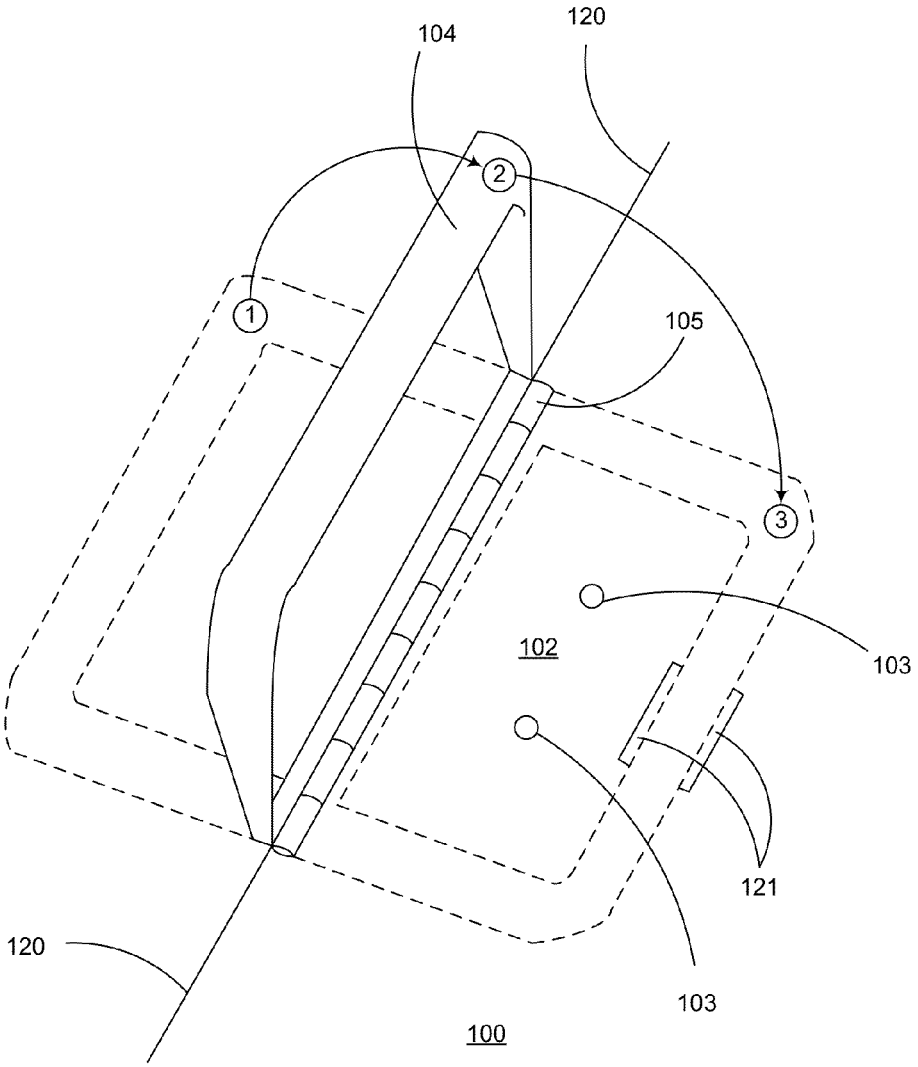
FIG. 2 is a perspective view of the exemplary snowboard accessory.

FIG. 2 is a perspective view of the exemplary snowboard accessory. As can be seen in this embodiment, the handle 104 is operable to rotatably move from a first position for carrying the snowboard, to a second position for doing tricks while riding the snowboard, and to a third latched position for use while riding the snowboard. The hinge 105 allows the handle 104 to lock in each of the positions according to what the rider desires, as explained above. While in the third latched position, the handle 104 may be secured by a latching mechanism 121. For example, the latching mechanism 121 may be configured as a semi-rigid plastic having a dimension of about the size of the grip of the handle 104 (e.g., a compression clip). This allows the handle 104 to "clip" into the latching mechanism 121 to further secure the handle 104 to the snowboard 100. Of course, other latching means may be employed.

Also seen in this embodiment again are the screw holes 103 that allow the attachment plate 102 of the handle 104 to secure the structure to the snowboard 100. It should be noted, however, that the invention is not intended to be limited to any particular form of attachment means. For example, the plate 102 may be affixed to the top surface of the snowboard 100 by means of a relatively strong glue or epoxy that allows for a relatively strong bond of the handle 104 to the top surface of the snowboard 100. Additionally, it should be noted that the invention is not intended to be limited to just the one direction of travel for the handle 104. Rather, the handle may be unclipped from the latching mechanism 121 and rotated to the other positions as desired by the rider of the snowboard 100.

Figure 3:
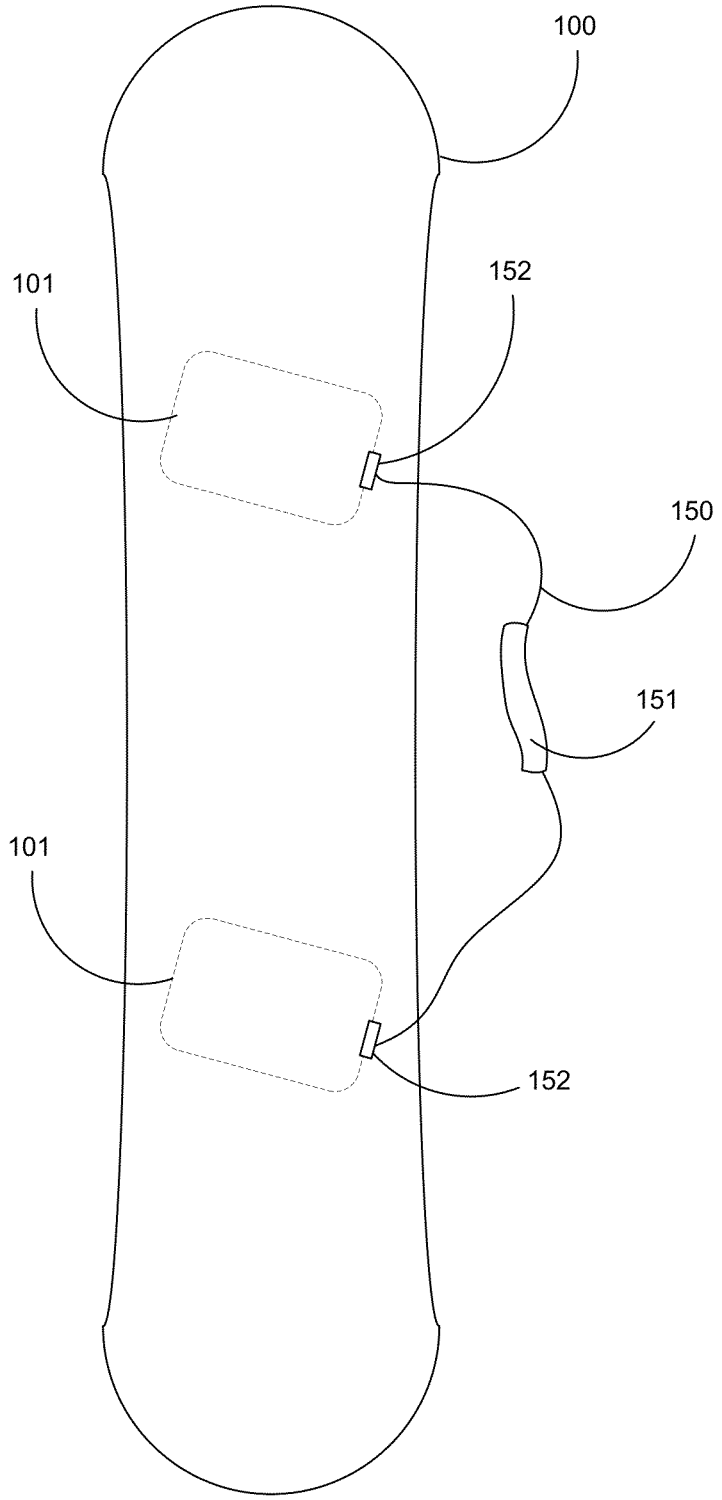
FIG. 3 is a block diagram illustrating an exemplary system for carrying a snowboard.

FIG. 3 is a block diagram illustrating an exemplary system for carrying the snowboard 100. In this embodiment, a strap is configured for attachment to snowboard bindings positioned at the binding locations 101 of the snowboard 100. For example, snowboard bindings are secured to the top surface of the snowboard 100 at the binding locations 101 in typical fashion. Once secured to the top surface of the snowboard 100, the strap 150 may be coupled to connectors 152 on the snowboard bindings themselves. An example of such a connector is shown in FIG. 4.

The strap 150 may also include a padded section 151 to provide additional comfort to the rider when carrying the board. For example, with the strap 150 attached to the connectors 152 on the snowboard bindings, the rider of the snowboard 100 may sling the strap 150 over the rider's shoulder so that the rider can easily "hands-free" carry the snowboard 100. When preparing to mount the snowboard, the rider simply detaches the strap 150 from the connectors 152 on the bindings and stows the strap. For example, the rider may roll the strap 150 into a circle to occupy a smaller space and then place the strap 150 into the rider's jacket or pants pocket.

Figure 4:
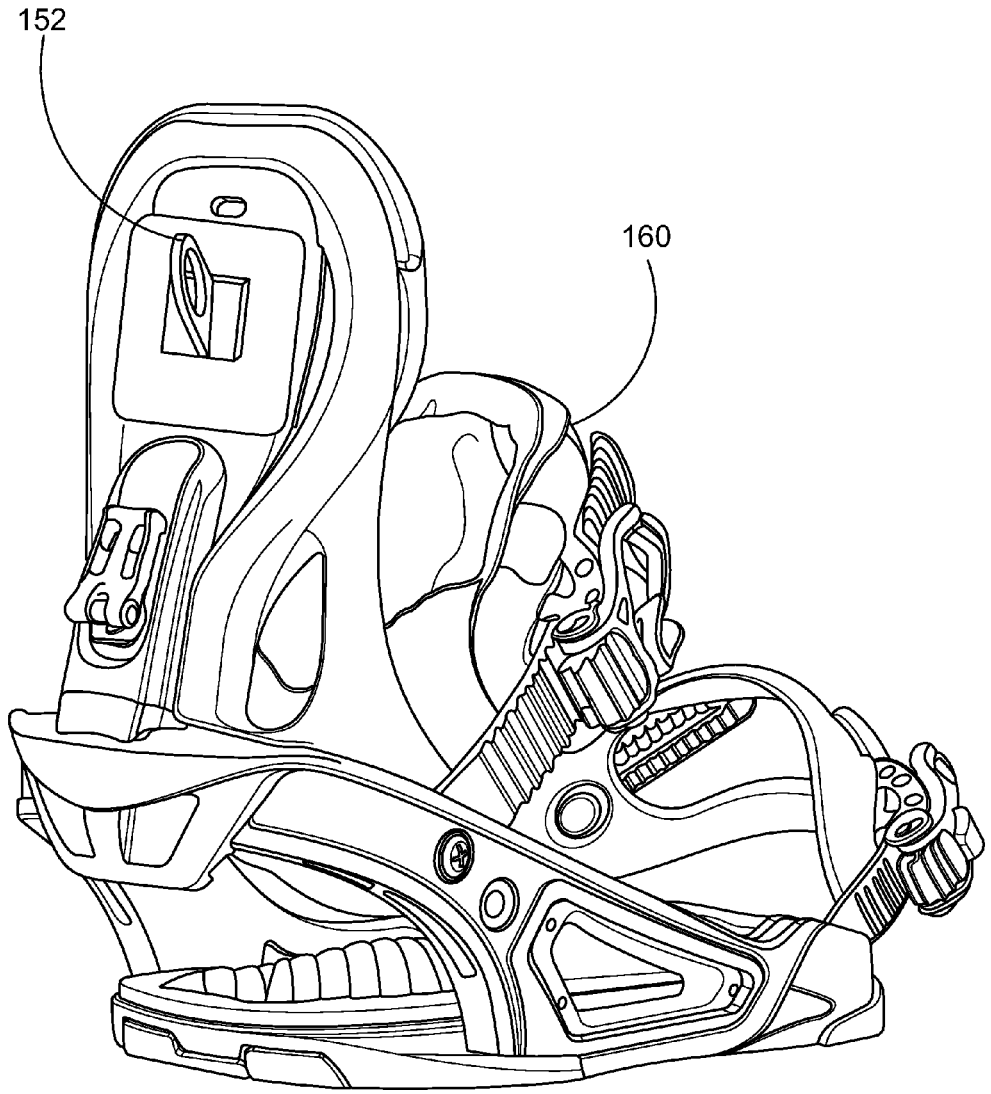
FIG. 4 is a snowboard binding with an exemplary attachment to provide the carrying system of FIG. 3.

FIG. 4 is a snowboard binding 160 with an exemplary connector 152 to provide the carrying system of FIG. 3. In this embodiment, the connector 152 is shown as a ring that is either a part of the snowboard binding 160 or affixed to a surface of the snowboard binding. Thus, when a snowboard binding 160 is affixed to the snowboard binding locations 101 on the top surface of the snowboard 100, the strap may be secured to the connectors 152 as illustrated in FIG. 3.

The manner in which the strap 150 is secured to the connectors 152 may be a matter of design choice. For example, the strap 150 may be configured from fabric with clasping mechanisms affixed to the ends of the strap 150 (e.g., sewn into the ends of the strap 150). These clasps then clasp onto the connectors 152 to secure the strap to the snowboard 100 such that the rider may shoulder carry the snowboard 100 during transport.

Figure 5:
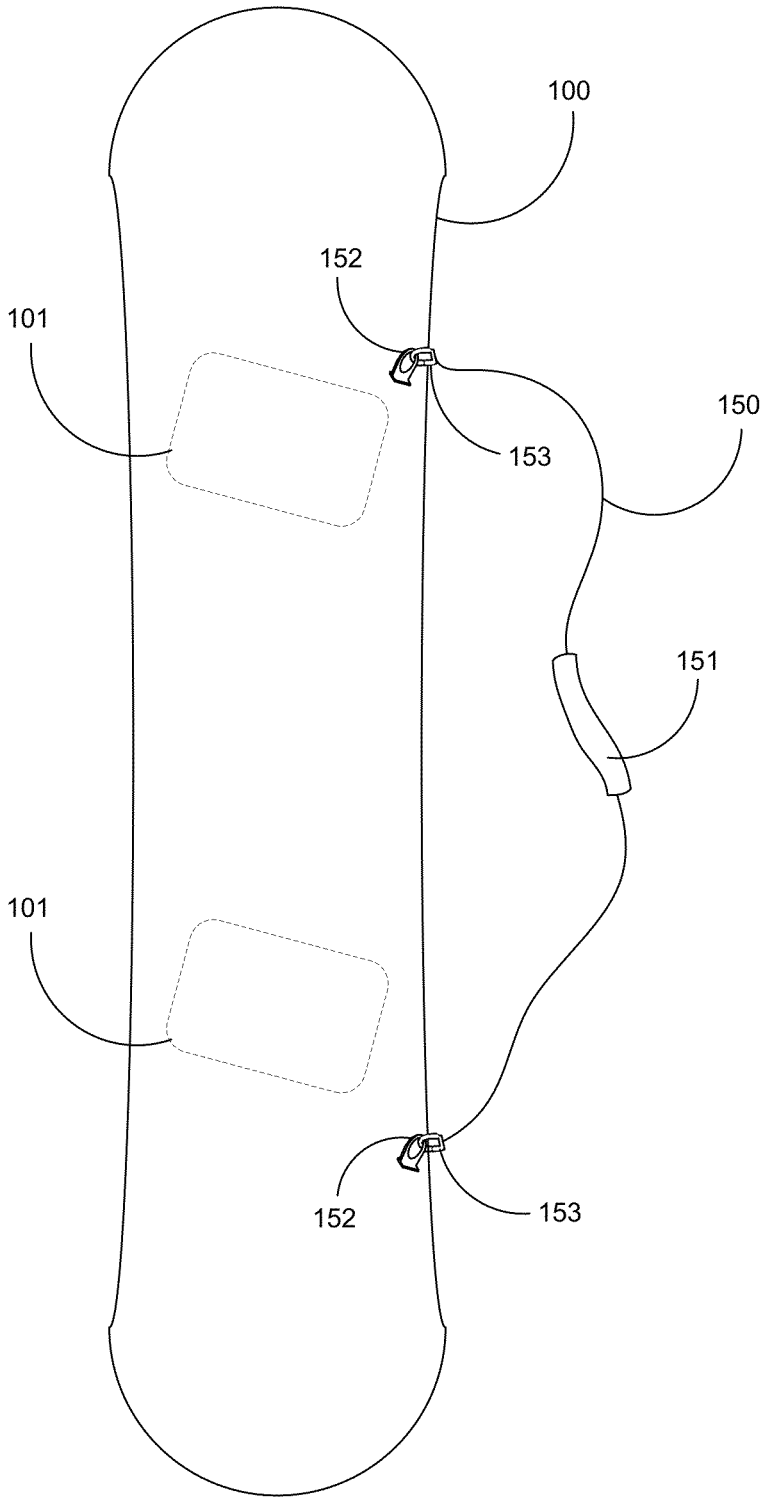
FIG. 5 is a block diagram illustrating another exemplary system for carrying a snowboard.

While this means of harnessing the strap 150 to the snowboard 100 is relatively unobtrusive to the snowboard rider, the invention is not intended to be limited to the illustrated embodiment. FIG. 5 is a block diagram illustrating another exemplary system for carrying a snowboard 100. In this embodiment, the connectors 152 are mounted to the top surface of the snowboard 100 (e.g., proximate to the snowboard binding locations 101). For example, the connectors 152 may be configured with flat services that allow for the attachment of the connectors 152 to the top surface of the snowboard 100. From there, the rider may affix the strap 150 to the connectors 152 using the clasping mechanisms 153 at the ends of the strap 150. Afterwards, when the rider is preparing to mount the snowboard 100, the rider simply detaches the strap 150 by unclasping the strap from the connectors 152 then stowing the strap 150.

Figure 6:
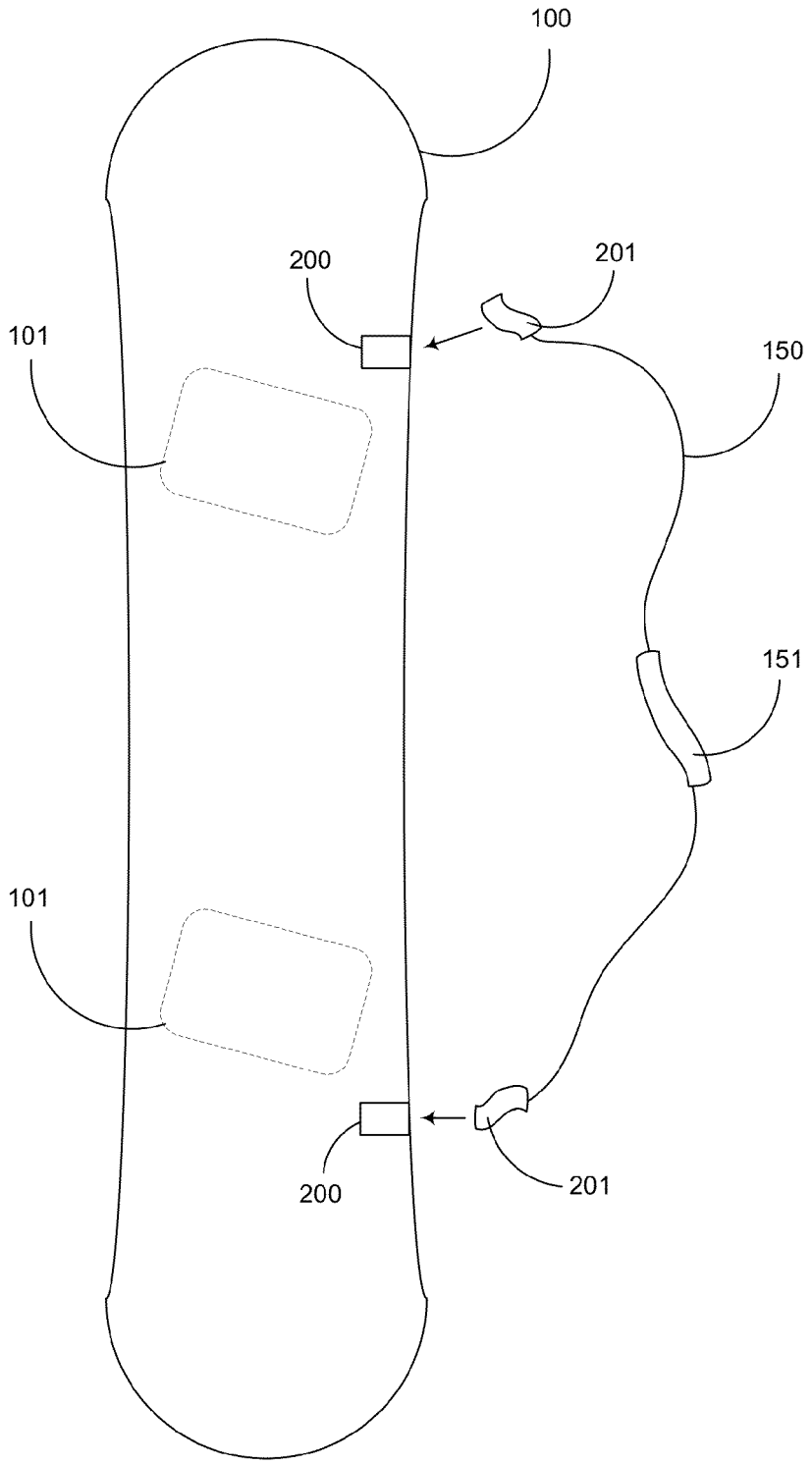
FIG. 6 is a block diagram illustrating another exemplary system for carrying a snowboard.

FIG. 6 is a block diagram illustrating another exemplary system for carrying the snowboard 100. In this embodiment, the strap 150 is configured with patches of hook and loop material 201 at the distal ends of the strap 150. An opposing form of the material is configured as patches 200 on the top surface of the snowboard 100 as patches 200. For example, the patches 201 may be a hook material sewn to the end of the strap 150 while the patches 200 may be patches of loop material affixed to the top surface of the snowboard with an adhesive, or vice versa. Examples of such include the well-known hook and loop material products of Velcro.

With the patches 200 secured to the top surface of the snowboard 100. The rider may simply secure the strap 150 to the patches 200 with the opposite material patches 201. Hook and loop materials are available in a variety of strengths. So, the particular type of hook and loop material used on the snowboard 100 is generally a matter of design choice. However, the hook and loop material should have an adhesion strength that is at least capable of allowing the rider to carry the snowboard hands-free (e.g., each patch combination 200/201 should be able to withstand about half of the weight of the snowboard 100 and bindings, approximately 5 to 10 pounds).

Although shown or described with respect to providing a system for more easily carrying a snowboard 100, the invention is not intended to be limited to such. Rather, the systems and methods described herein may also be operable with other forms of boards, such as wake boards used on water. Thus, while the invention has been illustrated and described in detail in the drawings and foregoing description, such illustration and description is to be considered as exemplary and not restrictive in character. Certain embodiments described hereinabove may be combinable with other described embodiments and/or arranged in other ways. Accordingly, it should be understood that only the preferred embodiment and variants thereof have been shown and described and that all changes and modifications that come within the spirit of the invention are desired to be protected.

What is claimed is:

1. A system comprising:

at least one grasping means affixed to a top surface of a snowboard; and an attachment means for affixing the at least one grasping means to the top surface of the snowboard, wherein the at least one grasping means allows a snowboarder to grab the snowboard to carry the snowboard, wherein the at least one grasping means comprises:

a hinge affixed to the top surface of the snowboard near and along a lengthwise edge of the snowboard;

a handle affixed to the hinge; and a locking means for securing the handle in a first position while the snowboarder rides the snowboard when the snowboarder is secured to the snowboard with bindings, wherein the hinge is operable to provide movement of the handle from the first position proximate to the top surface of the snowboard to a second position away from the edge of the snowboard to allow the snowboarder to grab the handle to carry the snowboard, and wherein the hinge is further operable to provide movement of the handle to a third position between the first and second positions and to lock the handle into the third position to allow the snowboarder to grab the snowboard to perform a trick while the snowboarder rides the snowboard.

2. The system of claim 1, wherein:

the attachment means comprises an attachment plate affixed to the hinge; and at least one screw operable to secure the hinge to the top surface of the snowboard.

3. The system of claim 1, wherein:

the locking means comprises a compression clip configured from a semi-rigid plastic that is operable to retain the handle in the first position while the snowboarder rides the snowboard.

* * * * *